US005745973A

United States Patent [19]

Kohlhaas

[11] Patent Number: 5,745,973

[45] Date of Patent: May 5, 1998

[54] PALLET ASSEMBLY

[76] Inventor: Frank Anthony Kohlhaas, 130 Lake Julia Dr. North, Ponte Vedra Beach, Fla. 32082

[21] Appl. No.: 781,130

[22] Filed: Jan. 9, 1997

[51] Int. Cl.[6] ..... B23P 11/00; B65D 19/16

[52] U.S. Cl. ..... 29/432; 29/464; 29/450; 108/56.3

[58] Field of Search ..... 29/464, 432, 456; 108/52.1, 53.1, 56.3

[56] References Cited

U.S. PATENT DOCUMENTS 3,610,172 10/1971 Wharton .
3,804,032 4/1974 Baucom .
3,915,099 10/1975 Wies et al. .
4,425,852 1/1984 Riviere .
4,604,014 8/1986 Frano ..... 108/56.3
5,183,426 2/1993 Ho-jin et al. ..... 29/448
5,193,464 3/1993 Morden .
5,193,973 3/1993 Tübke ..... 108/52.1
5,367,961 11/1994 Arai et al. ..... 108/56.3

*Primary Examiner*—S. Thomas Hughes
*Assistant Examiner*—Tisa Stewart
*Attorney, Agent, or Firm*—Thomas C. Saitta

[57] ABSTRACT

A pallet assembly comprising in combination a single deck member and multiple leg members, the leg members being threadingly attached to said deck member. The leg members comprise a hollow interior formed by a bottom and side wall, preferably circular in cross-section, with a peripheral flange to support the deck member and an annular, threaded aperture ring corresponding to circular apertures within the deck member.

3 Claims, 3 Drawing Sheets

PALLET ASSEMBLY

BACKGROUND OF THE INVENTION

This invention relates generally to pallets constructed for use with fork lifts or hand trucks, the pallets comprising a generally horizontal deck member composed of a relatively solid material with multiple discrete support columns or legs maintaining the upper deck member a sufficient distance above the ground to allow for easy insertion of the lifting tines of fork lifts or hand trucks. More particularly, the invention relates to single-deck pallets having multiple legs which are easily disassembled and assembled from the deck member, and where the pallets are nestable in a vertical manner when empty, such that storage and transportation is more efficient. Even more particularly, the invention relates to pallet assemblies in which the leg members comprise threaded engagement members for attachment to the deck member, and the method for assembling the pallets.

Pallets for supporting items for storage or transport composed of single deck members with multiple depending leg members to raise the deck member sufficient distance from the ground to allow access for fork lifts or hand trucks in order to move the pallet are well known in the industry. The pallets must be constructed with suitable strength and durability characteristics, as they are routinely subjected to relatively rough handling and treatment. It is often advantageous to provide a pallet assembly where the legs can be removed from the deck member, such that the pallet assembly can be disassembled and reassembled when desired. The ability to disassemble the pallet may be useful for transporting or storing large numbers of empty pallets, as well as allowing for replacement of individual components, either the legs or the deck members, which become damaged in use. It is also useful if the pallets are constructed such that they are nestable, the legs of one pallet fitting into the interior of the legs of a pallet beneath it, such that the deck of the upper pallet will rest on or close to the deck of the lower pallet. This allows fully assembled pallets to be stored and transported efficiently since a large number of pallets can be stacked so as to occupy minimal total volume.

Pallets which are nestable, which easily disassemble when desired, and which have multiple component leg member structures are known. For example, Wharton U.S. Pat. No. 3,610,172 shows a multiple component leg construction for use with dual deck pallets. Baucom U.S. Pat. No. 3,804,032 teaches a single deck member with nestable legs which easily disassemble and reassemble. The legs are single piece members with dual flanges for gripping the deck member. The deck apertures are cut with tabs or slots which allow the leg members to be inserted onto the deck member by twisting or sliding. This construction does not provide a very secure engagement between the legs and deck, and is only useful for pallets with decks constructed of a compressible paperboard material such as corrugated cardboard. Wies et al. U.S. Pat. No. 3,915,099 discloses a pallet construction which could be used for single deck, nestable leg pallets. This patent shows a single piece leg member which is designed to grip the deck member between a lower annular flange and upper horizontal tab members. As in Baucom, the circular pallet apertures to receive the legs are provided with cutouts which correspond to the positions of the horizontal tabs on the leg, such that the leg member is inserted so that the tabs pass through the cutouts, and the leg is then rotated to grip the deck member. Again the deck must be compressible, so that again the pallet is not securely constructed. Riviere U.S. Pat. No. 4,425,852 teaches a two part leg construction for use with single decks. The legs are nestable and easily assembled, but are not designed to disassemble. The Riviere leg has a hollow, truncated cone configuration with an annular flange to engage the upper side of the deck member and several annular locking shoulders positioned at a point beneath the bottom of the deck. A locking ring is placed onto the leg from the underside and pushed upward to compress the deck member and position its bottom rim above the locking shoulder. Morder U.S. Pat. No. 5,193,464 shows a tabbed leg member similar to the device of Wies et al., such that cutouts are required in the leg apertures for insertion of the leg, this leg having an inverted truncated cone in the center of the leg to provide a support surface interior to the leg opening.

It is an object of this invention to provide a pallet assembly comprising a single deck member for supporting objects and a number of leg members to raise the deck a suitable height from the floor to allow for insertion of fork truck or hand truck tines, which is easily assembled and disassembled, which allows multiple pallets to be stacked in a nesting manner whereby the least amount of space is occupied by the stacked pallets, and which provides an extremely, strong, sturdy and durable pallet assembly resistant to damage from compressive and shearing forces. It is a further object to provide such a pallet assembly which can be utilized with non-compressible deck members such as plywood, and wherein the leg members may be easily fabricated from metal or plastic. It is a further object to provide such a pallet assembly where the legs comprise a threaded upper portion adapted to conform to the inner diameter of circular apertures in the deck member, such that the legs are attached to the deck member by rotating the legs, causing the threaded members to cut into the inner wall of the aperture.

SUMMARY OF THE INVENTION

Figure 1:
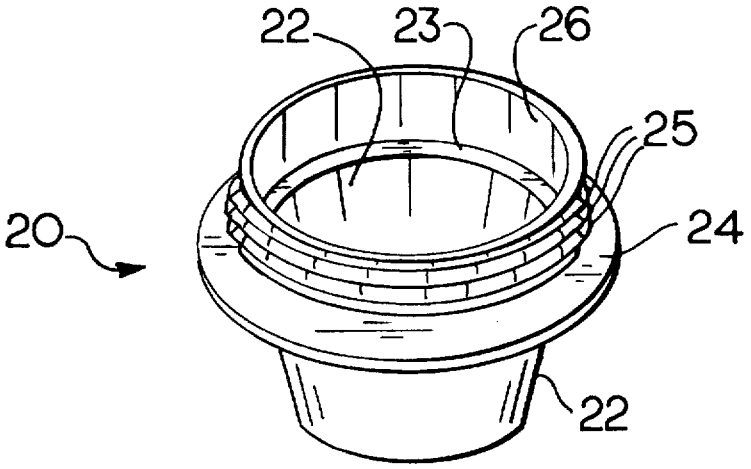
FIG. 1 is a perspective view of the leg member of the invention.

The invention is a pallet assembly comprising a single deck member and multiple legs attached to the deck member and the methodology for properly aligning and attaching the legs to the deck member. The deck member may be composed of any suitably durable, non-compressible and strong material capable of securely receiving threaded members of a leg member within a circular aperture, including plywood, wood, hard plastic, composite board or like material, and is preferably composed of plywood of sufficient thickness to prevent excessive flex when under load, to allow insertion of a relatively large number of threads, and to provide sufficient structural support for large weight. A number of circular apertures to receive the leg members are positioned in the deck member so as to allow unimpeded access lanes for insertion of fork lift or hand truck tines between the individual leg members in order to transport the pallet assembly. The leg members are of sufficient height to support the deck member in a horizontal position the required distance from the floor to allow access by the fork lift or hand truck.

The legs members are composed of any suitably strong and durable material capable of supporting the weight of a loaded pallet, such as steel sheet metal or a high strength plastic such as PVC. The lower portion of the legs depending from the deck are preferably configured in a general truncated cone shape, although other cross-sectional shapes such as square, hexagonal, etc., are possible, with the diameter of the bottom or base of the leg being smaller than the diameter across the open top of the leg, such that the side wall slopes inwardly. The interior of each leg is designed such that the leg of another pallet assembly may be nested in close proximity within its open interior. Extending upwardly from the side wall a distance approximately equal to the height of the deck member is an annular aperture ring which is externally threaded, the threaded member providing the means to connect the leg member to the deck member. The threads are of sufficient depth to extend a good distance into the aperture wall of the deck member to securely attach the leg member to the deck member. A peripheral deck support flange extends radially outward from the aperture ring of the leg member, providing a horizontal surface to support the lower surface of the deck member. An annular shoulder or rib is positioned on the interior of the leg member at or adjacent the top of the side wall, at the same approximate height or below the peripheral flange. The annular aperture ring preferably extends a distance beneath the peripheral flange, such that the lower edge of one aperture ring rests on the upper edge of another aperture ring when pallet assemblies are stacked. The distance the aperture ring extends beneath the peripheral flange determines the separation distance between deck members.

Because the deck members must be composed of suitable solid material to securely receive and retain the threaded legs even when under heavy load, it is likely that mechanical means will be required to attach the legs to the deck member. Additionally, it is imperative that the legs be properly aligned within the circular apertures when rotated for insertion, as improper alignment could damage the aperture wall and prevent adequate retention. Therefore mechanical insertion means must be provided to rotate the leg members with sufficient force for the threads to bite into the deck member. The insertion means must also properly align the leg member during the insertion process. To accomplish this, a wrench is provided which has means to grip the depending portion of the leg, means to properly align the leg relative to the aperture in the deck member prior to insertion, and means to forcibly rotate the leg member to screw the threaded annular ring into the deck member.

DETAILED DESCRIPTION OF THE INVENTION

With reference now to the drawings, the invention will be described with regard to the best mode and preferred embodiment. The invention is in general a pallet assembly comprising a single deck member forming a horizontal support platform for carrying objects, the deck member having a number of depending leg members to support the deck a distance above the floor or other base surface, the legs being spaced such that there is access for fork lift or hand truck tines for movement of the pallet. The individual leg members are easily attached to or removed from the deck member using a wrench device. The pallet assembly is nestable with other like pallet assemblies such that when stacked vertically the pallets occupy a minimum amount of space.

Figure 2:
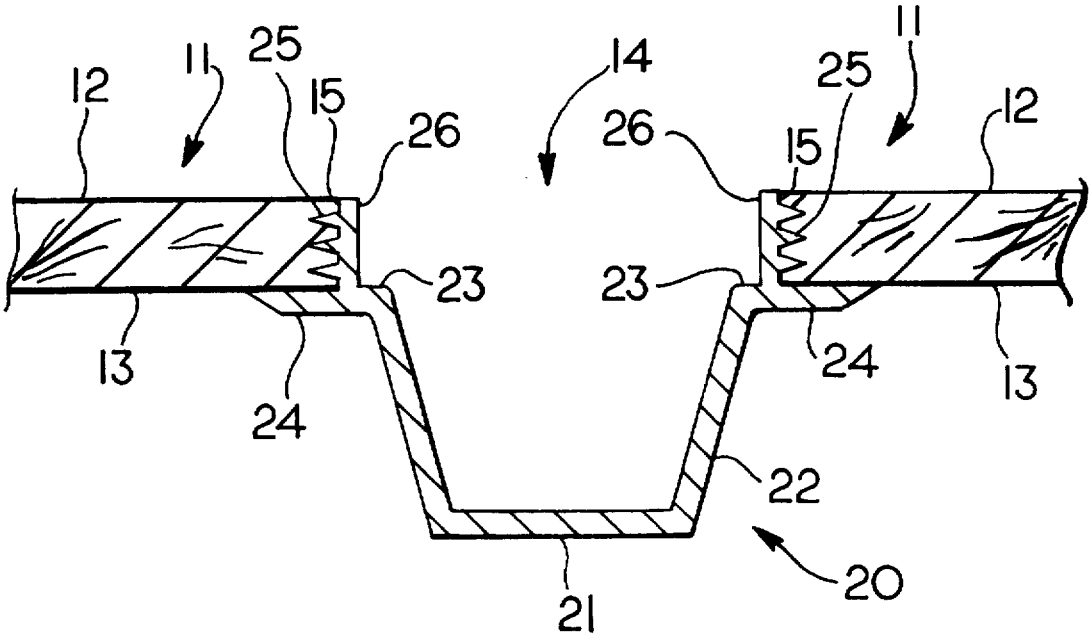
FIG. 2 is a cross-sectional view along the mid-point of the leg member, showing the leg member as connected to the pallet deck member.

With particular reference to FIGS. 1 and 2, the invention is seen to comprise a generally planar pallet deck member 11 with an upper surface 12 and a lower surface 13. The deck member 11 is composed of a strong, durable, rigid material capable of supporting a large weight without excessive flexing and having a relatively solid and dense interior, such as wood, composite material or plywood, with plywood being the preferred material. A number of circular apertures 14 are positioned at particular locations on the deck 11, the apertures 14 acting to receive leg members 20. The leg members 20 are positioned and are of sufficient height, preferably about three inches, to allow access lanes beneath the deck member 11 for the tines of fork lifts or hand trucks. The legs 20 should be of sufficient number to provide suitable support to the deck 11, preferably spaced in equidistant, symmetrical manner about the deck member 11.

Leg members 20 may be constructed of any suitable material having sufficient strength and durability properties, for example steel sheet metal, hard plastic such as PVC or the like. The depending or lower portion of the leg members 20 are preferably configured as truncated cones such that the diameter decreases in the downward direction. The legs 20 comprise a generally flat bottom 21, which could be configured to contain reinforcing structures if desired, with a sloping side wall 22 culminating in an annular inner shoulder or rim 23. The interior of the leg 20 is open to allow another leg 20 to be nested within.

Extending vertically upward from the top of side wall 22 and shoulder 23 is an annular aperture ring 26, whose outer diameter corresponds to the diameter of the circular aperture 14 and which preferably corresponds in height above peripheral flange 24 a distance generally equal to the thickness of the deck member 11. Peripheral support flange member 24 extends radially outward from aperture ring 26 and provides a generally horizontal support surface for the lower surface 13 of the deck member 11. Support flange member 24 may be segmented or may completely circumscribe side wall 22. Support flange member 24 should extend at least one half inch from the side wall 22, and may extend farther if needed for additional support due to the particular material of construction of deck member 11. The annular aperture ring 26 may extend a small amount above the upper surface 12 of the deck member 11, may extend only to slightly below the upper surface 12, or, in the preferred embodiment, extends a distance below the peripheral flange 24. The outer surface of the aperture ring 26 above the peripheral flange 24 is provided with single or multiple threads 25, which are preferably a continuous helical or spiral member having a generally triangular cross-section, similar in construction to the threaded portions of a typical wood or sheet metal screw. Threads 25 are preferably self-threading, such that the aperture wall 15 does not need to be correspondingly threaded prior to insertion.

To secure the leg members 20 to the deck member 11, a leg member 20 is positioned on the lower surface 13 side of the deck member 11 such that the annular aperture ring 26 mates with the circular aperture 14. Exerting pressure, the leg 20 is rotated such that the thread 25 bites into the aperture wall 15. Rotation of the leg 20 is continued with the threaded member 25 pulling the aperture ring 26 into the aperture 14 until the upper surface of the peripheral flange 24 abuts the lower surface 13 of the deck member 11 and no further rotation is possible. It is preferred that the upper edge of aperture ring 26 be flush with or just below the upper surface 12 of the deck member 11 at full insertion so as not to interfere with loading and unloading the pallet assembly. It is also preferred that the deck member 11 be of sufficient thickness and the threads 25 be tightly configured such that the threads 25 enter the aperture wall 15 a plural number of times along any vertical section of the aperture wall 15.

Figure 4:
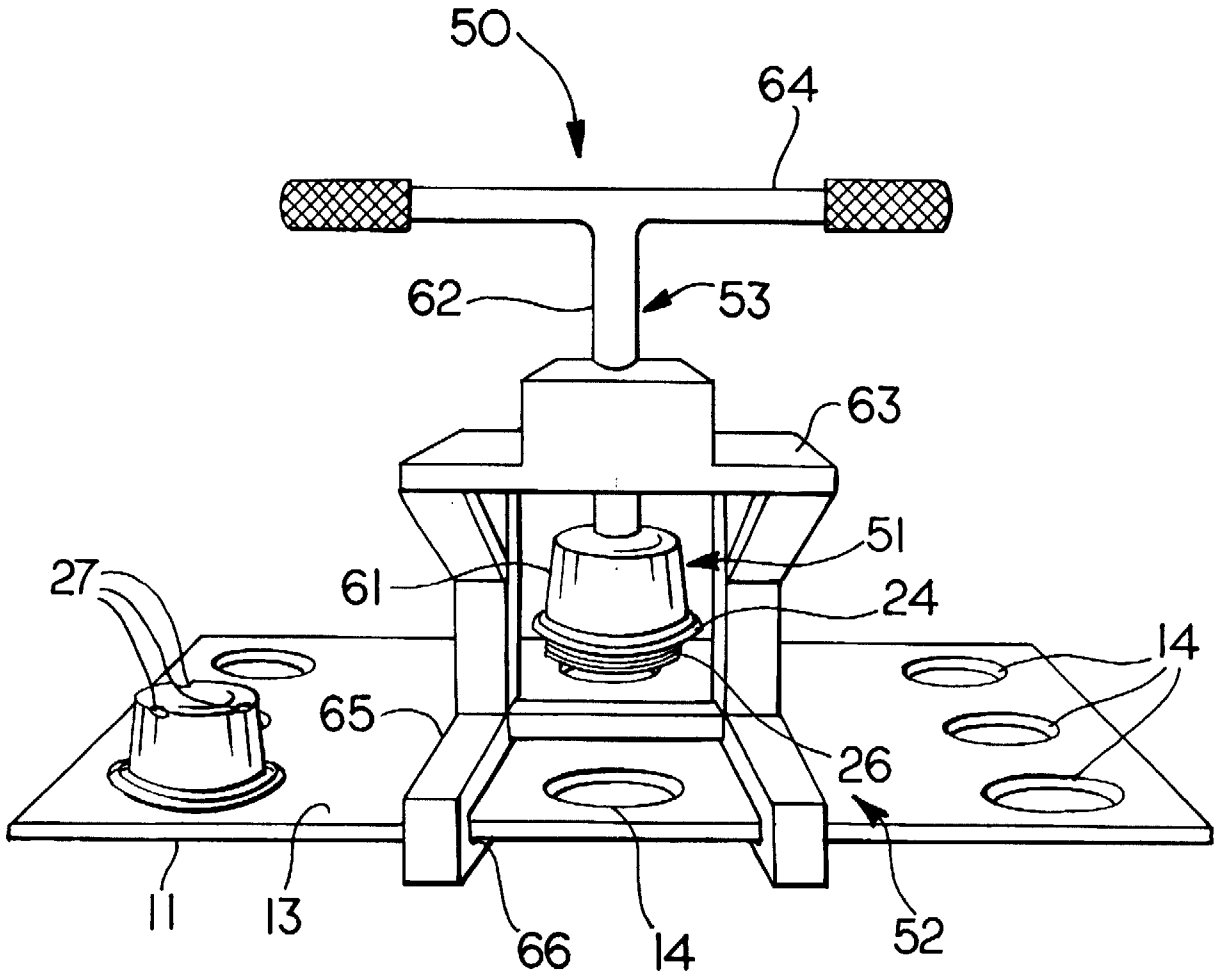
FIG. 4 is a view showing an assembly apparatus for properly attaching the leg members to the deck member.

Because deck members 11 must be constructed of relatively hard material in order to properly secure the leg members 20 over long periods of use, it is preferred and probably required that the pallet assembly be assembled using a mechanical insertion means, such as a hand or powered wrench apparatus 50, as shown in FIG. 4, to properly align and rotate the legs 20 into the circular apertures 14. The wrench 50 is comprised of gripping means 51 to retain the leg 20 to be inserted, alignment means 52 to properly position the leg 20 relative to the aperture 14, and drive means 53 to rotate the leg and screw the threads 25 into the aperture wall 15. A simple hand-powered embodiment is illustrated in FIG. 4, where the gripping means 51 comprises a receptacle head 61 with an internal configuration matching the external configuration of a leg 20, such that the side wall 22 and bottom 21 of the leg 20 is retained within the receptacle head 61 by suitable mechanical or magnetic means. To assist in the transfer of rotation force to leg 20, it is preferred to provided notches or apertures 27 in the bottom 21 of leg 20, with corresponding tabs or lugs provided within the receptacle head 61. A shaft 62 is axially attached to the gripping means 51 and extends through a support frame 63. A handle 64 is attached to the free end of shaft 62. The support frame 63 is preferably provided with alignment means 52 which as shown may comprise a base 65 with positioning members 66 which overlap the edge of the deck 11 to properly align the wrench 50 relative to the aperture 14. Alternatively, means may be provided to align the wrench 50 relative to the other apertures 14 rather than or in addition to the edge of deck member 11. With the leg 20 positioned in the receptacle head 61, the shaft 62 is forced downward to properly locate the threaded aperture ring 26 abutting aperture 14. Rotation of handle 64 then causes threads 25 to bite into the aperture 15, pulling the leg 20 into the aperture 14. The wrench 50 insures that the leg 20 is properly aligned relative to the deck 11. When the peripheral flange 24 meets the lower surface 13 of deck 11, rotation is stopped and the wrench 50 is removed from the now securely attached leg member 20. It is contemplated that wrenches 50 may be designed allowing insertion of all legs 20 into a pallet at one time, as well as mechanized or powered versions of the apparatus equivalent to the apparatus as shown.

Figure 3:
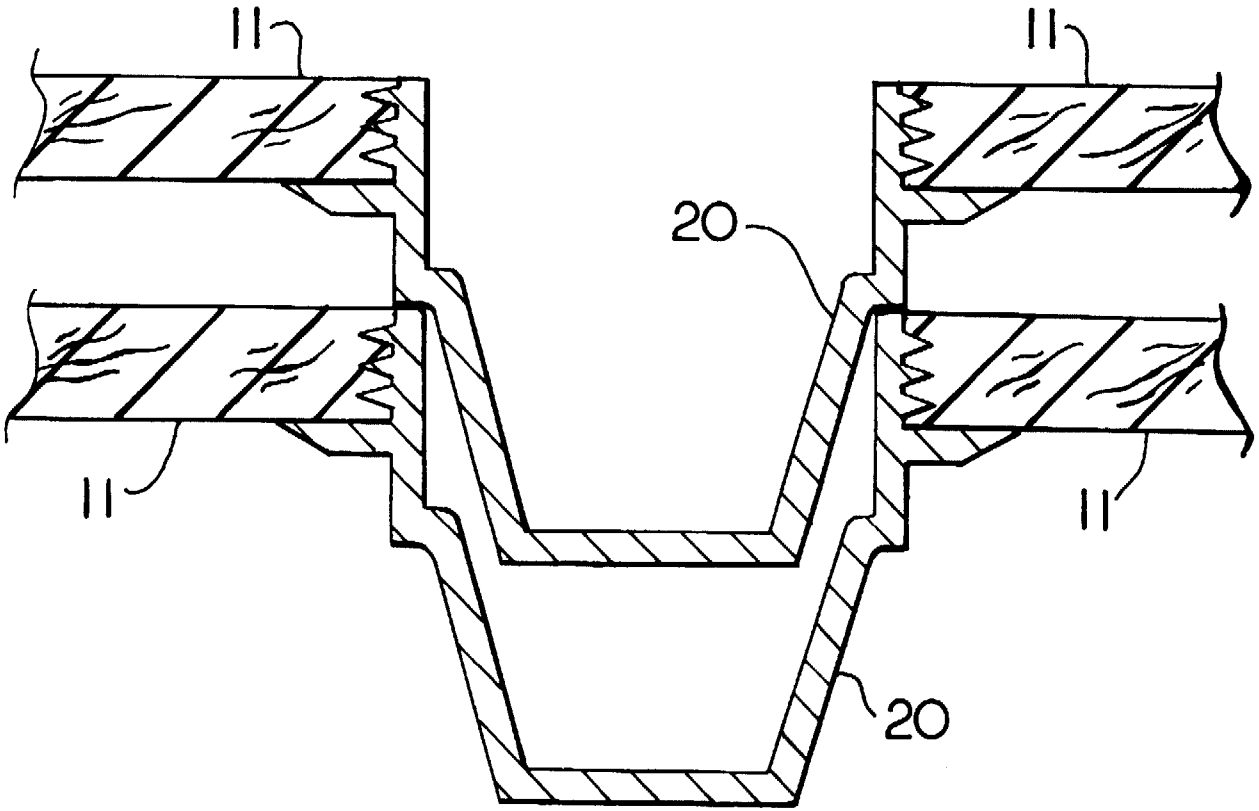
FIG. 3 is a cross-sectional view showing two pallets stacked in a nested manner.

The invention allows multiple pallet assemblies to be nested for storage or transportation purposes, each leg member 20 fitting within the lower leg member 20 such that the adjacent deck members 11 are only slightly separated. The distance the aperture ring 26 extends beneath the peripheral flange 24 determines the amount of vertical separation between adjacent deck members 11 when pallet assemblies are nested, with a separation distance of approximately ½ inch between decks 11 being preferred to allow for easy separation. As shown in FIG. 3, the lower edge of the aperture ring 26 on the upper leg 20 will rest on the upper edge of the aperture ring 26 or the lower leg 20 when the pallets are stacked.

While the preferred configuration for the depending portion of leg members 20 is circular in cross-section, the invention could be practiced with the depending side walls 22 configured in different shapes, such as square, hexagonal, etc., without departing from the intent of the invention. Such non-circular configurations would provide shoulders for easier rotation of the legs 20 during insertion into the deck member 11. Other equivalents and substitutions may be apparent to those skilled in the art as well, so therefore the true scope and definition of the invention is to be as set forth in the following claims.

I claim:

1. A method for assembling a pallet assembly comprising a single deck member and multiple leg members attached to and depending from said deck member, said deck member composed of a generally solid, non-compressible material and having a number of circular apertures, said leg members each comprising a bottom, a side wall connected to said bottom, an annular aperture ring having external threads extending from said side wall, a peripheral flange extending outwardly from said aperture ring and abutting said deck member, where the exterior diameter of said aperture ring corresponds to the interior diameter of said circular aperture whereby said threads bite into said deck member when said aperture ring of said leg member is inserted and rotated within said aperture to securely attach said leg member to said deck member, the method comprising the steps of providing mechanical insertion means for insertion of the individual leg members into said apertures of said deck member, said mechanical insertion means comprising gripping means to retain a respective said leg member, alignment means to properly align said leg member relative to said aperture, and drive means to rotate said leg member within said aperture to attach said leg member to said deck member, positioning said leg member in said gripping means, aligning said leg member with said aperture, rotating said leg member relative to said aperture to force said threads into said deck member until said peripheral flange abuts said deck member, and releasing said leg member from said gripping means.

2. The method of claim 1, where said gripping means comprises a receptacle head configured to correspond to said side wall of said leg member.

3. The method of claim 1, where said drive means comprises a handle and shaft attached to said gripping means.

* * * * *